United States Patent [19]

Collins et al.

[11] 4,030,444

[45] June 21, 1977

[54] CONTINUOUS SILK SCREEN WITH DIRECT ROLL COATER

[75] Inventors: George L. Collins, Murray Hill; John R. Costanza, North Plainfield, both of N.J.

[73] Assignee: Celanese Corporation, New York, N.Y.

[22] Filed: Nov. 26, 1975

[21] Appl. No.: 635,478

[52] U.S. Cl. ..... 118/257
[51] Int. Cl.[2] ..... B05C 1/14
[58] Field of Search ..... 101/122, 121; 68/204; 118/213, 257

[56] References Cited

UNITED STATES PATENTS

| | | | |
|---|---|---|---|
| 1,080,141 | 12/1913 | Delaney | 118/257 |
| 1,771,627 | 7/1930 | Hart | 101/122 |
| 2,056,274 | 10/1936 | Holdsworth | 101/122 X |

FOREIGN PATENTS OR APPLICATIONS

| | | | |
|---|---|---|---|
| 1,260,424 | 2/1968 | Germany | 101/122 |

*Primary Examiner*—John P. McIntosh

[57] ABSTRACT

There is disclosed a direct roll coating technique whereby a continuously revolving silk screen is interposed between the roll coating roll and the substrate to be coated. This silk screen serves to eliminate ridges which are usually formed when a direct roll coater is used. This technique is of special usefulness where ultraviolet curing of the coating on the substrate is contemplated.

4 Claims, 1 Drawing Figure

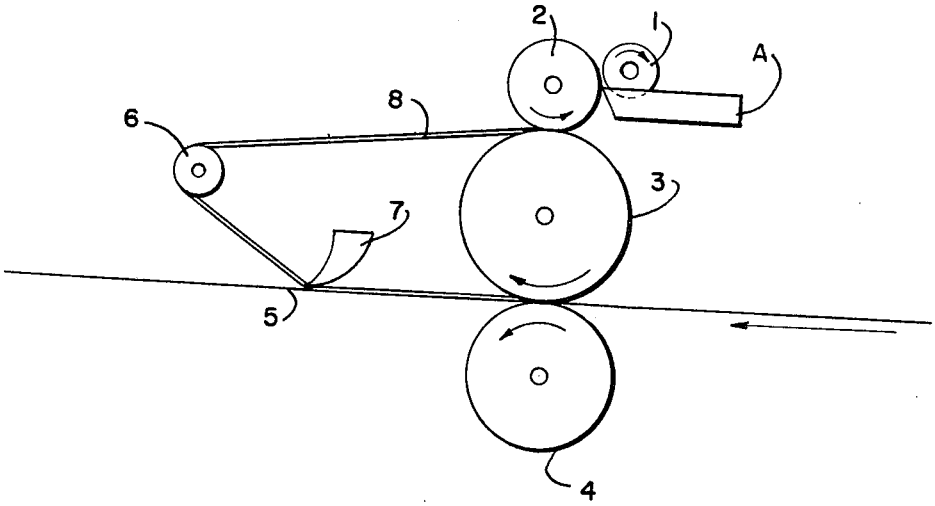
2
1
A
8
6
3
7
5
4

CONTINUOUS SILK SCREEN WITH DIRECT ROLL COATER

BACKGROUND OF THE INVENTION

This invention relates to roll coating processes, and in particular, to roll coating processes employed in conjunction with ultraviolet coating operations.

Roll coating basically involves the application of a coating to a moving metallic substrate which is fed between two rolls. The coating is fed onto one of the two rolls from other rolls which take up the coating material from a bath. See e.g., SCIENCE AND TECHNOLOGY, Vol. 3, "Coating Methods," pp. 765–830.

Most roll coating machines have been used in conjunction with heat curable coatings. Thus, the coating after it is applied to the substrate has a tendency to flow out on the initial application of heat. This flow-out, however, does not occur when low energy processes are employed. For example, ultraviolet curable coatings have been observed to be deficient in flow properties, especially when roll coating applications methods are employed.

Thus, it is an object of this invention to prepare a roll coating apparatus having improved roll coating capabilities.

It is another object of this invention to prepare a roll coater which eliminates ridges and other surface imperfections from coatings resulting therefrom.

It is another object of this invention to prepare a roll coater which may be utilized in conjunction with low energy curable coatings or with ultraviolet coatings.

These and other objectives are obtained by utilizing the process of the instant invention.

SUMMARY OF INVENTION

Basically, the instant invention involves the discovery that by interposing a continuously moving silk screen between the final coating roller on a roll coater and the substrate to be coated, it is possible to prepare cured coatings which do not exhibit the poor surface characteristics of prior art roll coated coatings. Utilized in conjunction with the continuous silk belt in the roll coater described herein is a resilient blade which is applied to the innermost edge of the silk screen and forces the screen into continuous contact with the substrate being coated.

DESCRIPTION OF THE DRAWING

FIG. 1 the single figure of the drawing, shows in diagramatic side elevation the apparatus of this invention. However, this drawing is meant to be merely illustrative of the invention, and is not included as limiting the scope thereof.

Referring to FIG. 1, rolls 1 and 2 are usually metal rolls, with 3 a resilient roll, and 4 another metal roll. Rolls 1 and 2 rotate respectively in clockwise and counter-clockwise fashion, with roll 1 being known as the takeup roll. This roller moves the coating from the bath A, which coating is metered to a particular thickness by the separation between rolls 1 and 2. The coating is then transferred onto the continuously moving silk screen belt 8, which revolves around roll 3 in a direction opposite from the direction of rotation for roll 2. The coating is carried on the belt into contact with the substrate to be coated 5, which is moving between the silk screen belt and roll 4. The silk screen belt is maintained in contact with the substrate by a resilient blade 7 or squeegee, and the belt continues rotating around roll 6 moving away from contact with the substrate.

The distance of silk screen contact to the substrate between the point of initial substrate contact with the silk screen and the resilient edge assures that no edges or ridges are caused to occur in the film.

Following travel through the roll coater, the substrate is either allowed to self-cure, or is subject to ultraviolet radiation having a wave length in excess of about 2000 Angstroms. Other means of low-energy curing include gamma radiation, electron beam radiation, and the like. Of course the apparatus of the instant invention is equally applicable to heat-curable systems, especially those having poor flow properties.

The coating bath itself (A) can contain any typical coating material which is curable under the conditions utilized. It should have sufficient viscosity so that is does not run or drip off the coating rolls. The viscosity should not be too great, however, so as to cause the coating to "bunch" or "creep" on the substrate. Generally, this means the viscosity of the coating should be in the range of about 5 cps to about 15,000 cps.

The resilient squeegee blade 7 should be formed of any material of sufficient strength to force the moving silk screen belt down onto the substrate to be coated. However, the material should also be flexible enough to insure that scratching of the substrate does not occur. Generally, the resilient blade will be formed of rubber or some sort of resilient plastic.

The term "silk screen" as utilized herein is not limited to webs formed of silk. Rather other fibers or fabrics having sufficient strength may be utilized. In general, the fabric should be woven to a United States Standard sieve or mesh size of about 8 to about 20. Examples of the fibers from which the silk screen may be formed, in addition to silk, include nylon, polyester, stainless steel and the like.

The speed at which the roll coater of this invention is operated depends upon a number of factors, including the width of the web to be coated, the viscosity of the coating material, coating thickness, etc. However, normally it can be operated at coating line speeds of up to about 300 ft./min.

The type of material which may be coated by this invention may range in thickness up to about 40 mils. However, the apparatus of this invention works particualrly well with metallic substrata having thicknesses in the range of about 6 mils to about 30 mils. Of course, as previously described, line speed will depend upon the thickness of the substrate, with thicker substrates requiring lower line speeds.

Coatings which may be applied by this invention may be applied to thicknesses ranging as low as 0.25 mils to as high as 3–4 mils.

What is claimed is:

1. In a roll coater having a takeup roll located in a coating bath, a nip roll located adjacent to the takeup roll, providing a sufficient separation between the takeup roll and the nip roll to meter the desired thickness of coating onto the nip roll, and driver rolls interposed on either side of a substrate to be coated, said nip roll located adjacent one of said driver rolls, wherein the driver rolls drive the substrate through the coater, the improvement of which comprises interposing between said one driver roll and the side of the substrate to be coated, a silk screen band which receives the coating from the nip roll, and which band is maintained in contact with the side of the substrate to be coated by a resilient blade located downstream of said driver rolls, wherein the band moves in the direction of flow of the substrate between the driver rolls at a speed equal to the line speed of the substrate.

2. the roll coater of claim 1 wherein the substrate to be coated has a film thickness in the range of about 6 to about 30 mils.

3. The roll coater of claim 1 wherein the silk screen is a fabric woven to U.S. Standard sieve or mesh size of about 8 to about 20.

4. The roll coater of claim 1 wherein the resilient blade is formed from rubber.

* * * * *